US005291699A

United States Patent [19]

Fujita

[11] Patent Number: 5,291,699

[45] Date of Patent: Mar. 8, 1994

[54] ROOF

[76] Inventor: Keiichi Fujita, 1887 Kizuki-sumiyoshicho Nakaharaku, Kawasaki-City Kanagawa-Prefecture, Japan

[21] Appl. No.: 991,537

[22] Filed: Dec. 15, 1992

[30] Foreign Application Priority Data

Dec. 17, 1991 [JP] Japan ..... 3-353433

[51] Int. Cl.[5] ..... E04D 13/00

[52] U.S. Cl. ..... 52/11; 52/64; 52/640; 52/645

[58] Field of Search ..... 52/95, 96, 90.1, 90.2, 52/640, 641, 11, 14, 15, 58, 61, 94; 248/48.1

[56] References Cited

U.S. PATENT DOCUMENTS

| | | | |
|---|---|---|---|
| 952,001 | 3/1910 | Davis | 52/92.3 |
| 3,785,108 | 1/1974 | Satchell | 52/645 |
| 3,967,419 | 7/1976 | Robinson | 52/95 X |
| 4,497,146 | 2/1985 | Demartini | 52/11 X |
| 4,551,956 | 11/1985 | Axford | 52/14 X |
| 4,769,526 | 9/1988 | Taduil | 52/11 X |
| 5,010,696 | 4/1991 | Knittle | 52/11 X |
| 5,181,350 | 1/1993 | Meckstroth | 52/11 X |

FOREIGN PATENT DOCUMENTS

| | | | |
|---|---|---|---|
| 814652 | 8/1951 | Fed. Rep. of Germany | 52/64 |
| 1477768 | 3/1967 | France | 52/640 |
| 660930 | 11/1951 | United Kingdom | 52/640 |

*Primary Examiner*—Peter M. Cuomo
*Assistant Examiner*—Jerry Redman
*Attorney, Agent, or Firm*—Sughrue, Mion, Zinn, Macpeak & Seas

[57] ABSTRACT

A roof includes a plurality of rafters each having at its upper end a connection and having at its lower end a fixing section, and a rod for retaining the rafters at predetermined intervals. The roof further includes a reinforcement material provided between the rafters, and an eaves trough extending along the periphery of the lower edge of the sheathing surface laid on the rafters. Accordingly, the labor hours required for, e.g., the positional change of the ridgepole or rafters when remodeling the conventional roof, are reduced, thereby enabling occupancy within the house under remodeling, as well as restraining the remodeling cost.

1 Claim, 6 Drawing Sheets

ROOF

BACKGROUND OF THE INVENTION

1. Field of the Invention

The present invention relates to a pitched roof.

2. Description of the Related Art

A method of forming the conventional roof of this type comprises the steps of providing a ridgepole as a top edge, providing side by side a multiplicity of rafters slantingly extending from the ridgepole, laying a sheathing plate over the rafters, and covering the sheathing plate with, for example, a roof tile material.

The method of forming the conventional roof like this further comprises the steps of fixing the ridge pole onto pillars, and successively providing a plurality of horizontal crossbeams each having a difference in height relative to the ridgepole, and providing the rafters originating from and slantingly extending on both sides of the ridgepole and supported by the crossbeams.

In the above-mentioned conventional roof structure, the ridgepole and rafters are initially fixedly positioned with each other. Accordingly, providing that it is desired at the time of remodeling to alter the height or slant of the roof, the entire roof frame composed of the ridgepole, the crossbeams and rafters needs to be rebuilt, which disadvantageously leads to a troublesome work and increased remodeling cost. More inconveniently, this remodeling work must be performed on a large scale, and hence it is impossible to reside within the house under remodeling.

In addition, the conventional roof structure described above needs a multiplicity of pillars for supporting the ridgepole and crossbeams, which adversely leads to a complicated and high-cost roof frame structure. Furthermore, the presence of the multiplicity of pillars may reduce an available space in an attic, which possibly make it impossible to utilize the attic as a storeroom.

SUMMARY OF THE INVENTION

The roof of the present invention intended to constitute a roof frame comprises a plurality of rafters 13, 13' having at its upper end a connection 11 and at its lower end a fixing section 12, and a rod 14 for retaining the connections 11 of the rafters 13, 13' at predetermined intervals.

The fixing sections 12 of the rafters 13, 13' are firmly attached to corresponding eaves beams 22 of a building structure 20. The rafters 13, 13' are arranged on both sides of the rod 14 in its axial direction, respectively. The rod 14 is positioned at a predetermined height in such a manner as to be raised by the rafter pairs located on both sides thereof.

The rafters 13, 13' are symmetrically combined in pairs. The rafter pairs 13, 13' are interlinked with each other by way of reinforcement members 17 spanning corresponding trunk portions of the rafter pairs 13, 13' and reinforcement members 18 diagonally extending across the adjacent rafter pairs 13, 13'.

A plate material 15 traverses between the adjacent rafters to form a sheathing surface 15'.

The roof of the present invention further comprises a drainage hole 50 provided in the region of the lower edge of the sheathing surface 15', an eaves trough 30 disposed below the drainage hole 50, a vertical portion 52 obtained by upwardly bending the lower extremity of the sheathing surface 15', a root catch 54 on which the vertical portion is placed, and a drip cover adapted to cover the lower edge and vicinity of the sheathing surface 15.

In the roof of the present invention, each of the rafters 13 has the upper end engaging with the rod 14 and the lower end linked with the eaves beam 22, and hence is fixedly attached between the rod 14 and the eaves beam 22, whereas the rod 14 is raised by the right and left rafters 13, 13' each supported on the corresponding eaves beams 22.

In other words, in the roof of the present invention, the rod 14 is fixedly positioned with respect to the rafters 13, 13' by fastening the rafters 13, 13' to the eaves beams 22.

DETAILED DESCRIPTION OF THE PREFERRED EMBODIMENTS

Figure 1:
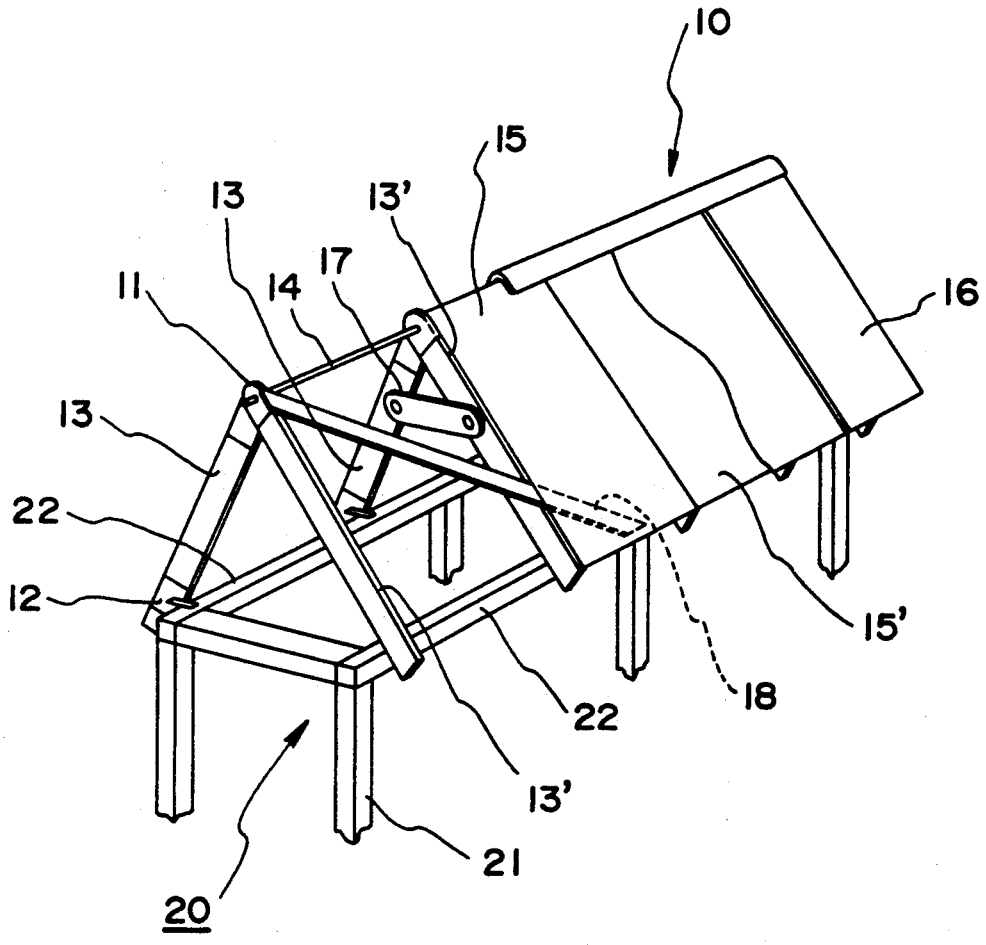
FIG. 1 is a perspective view of a building structure employing a roof in accordance with the present invention.

FIG. 1 is a schematic perspective view of a building structure 20 including a roof 10 in accordance with the present invention, in which the roof 10 is partially cut away.

Figure 2:
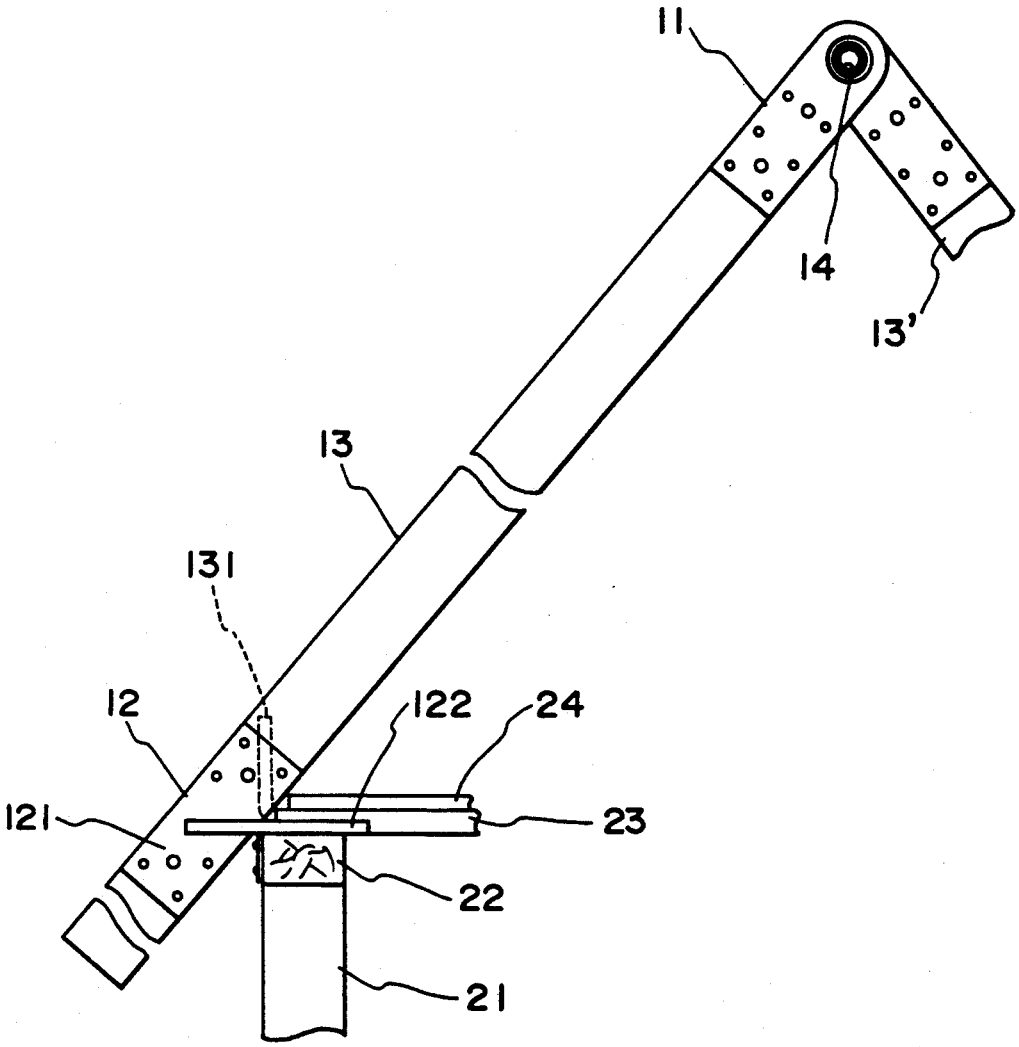
FIG. 2 is a side elevation showing the main portion of the roof of the present invention.
Figure 3:
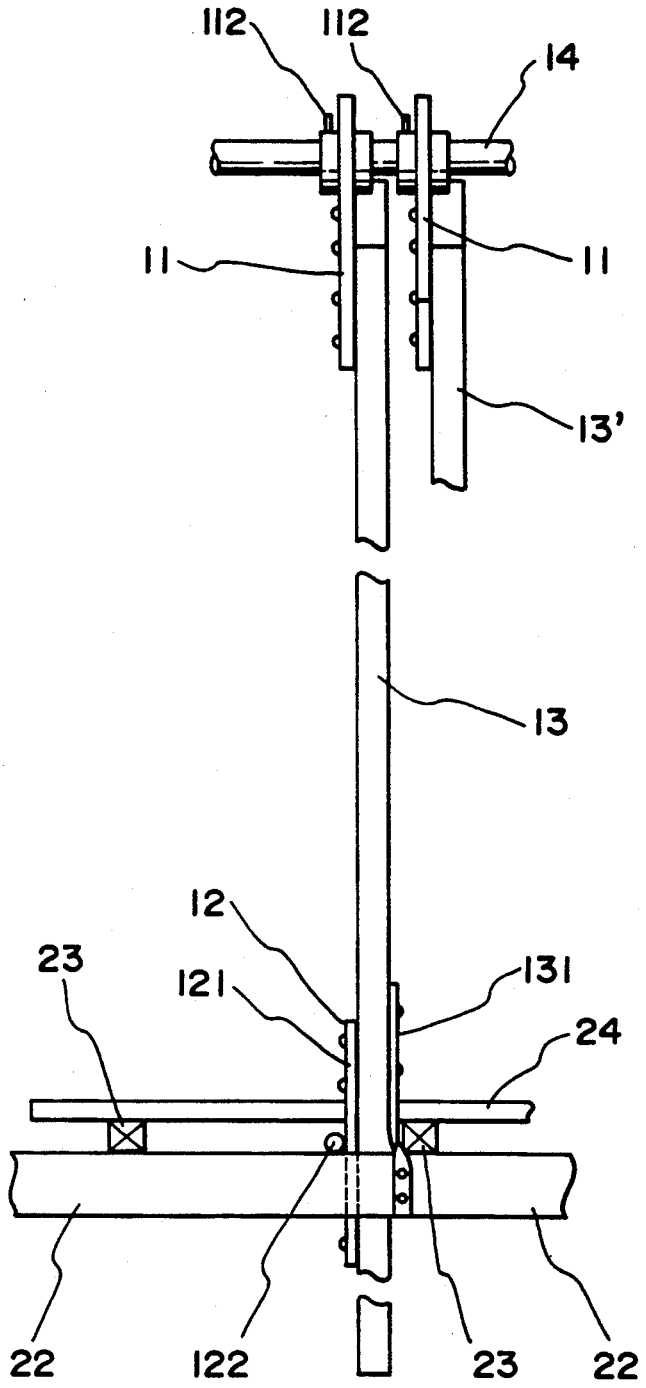
FIG. 3 is a rear elevation of the portion shown in the FIG. 2 when viewed from the rear side.

The building structure 20 comprises eaves beams 22 firmly attached to the pillars 21. As shown in FIGS. 2 and 3, crossbeams 23 traverse between the eaves beams 22, and a floor 24 made of a plate material such as a plywood is overlaid on the crossbeams 23.

Figure 4:
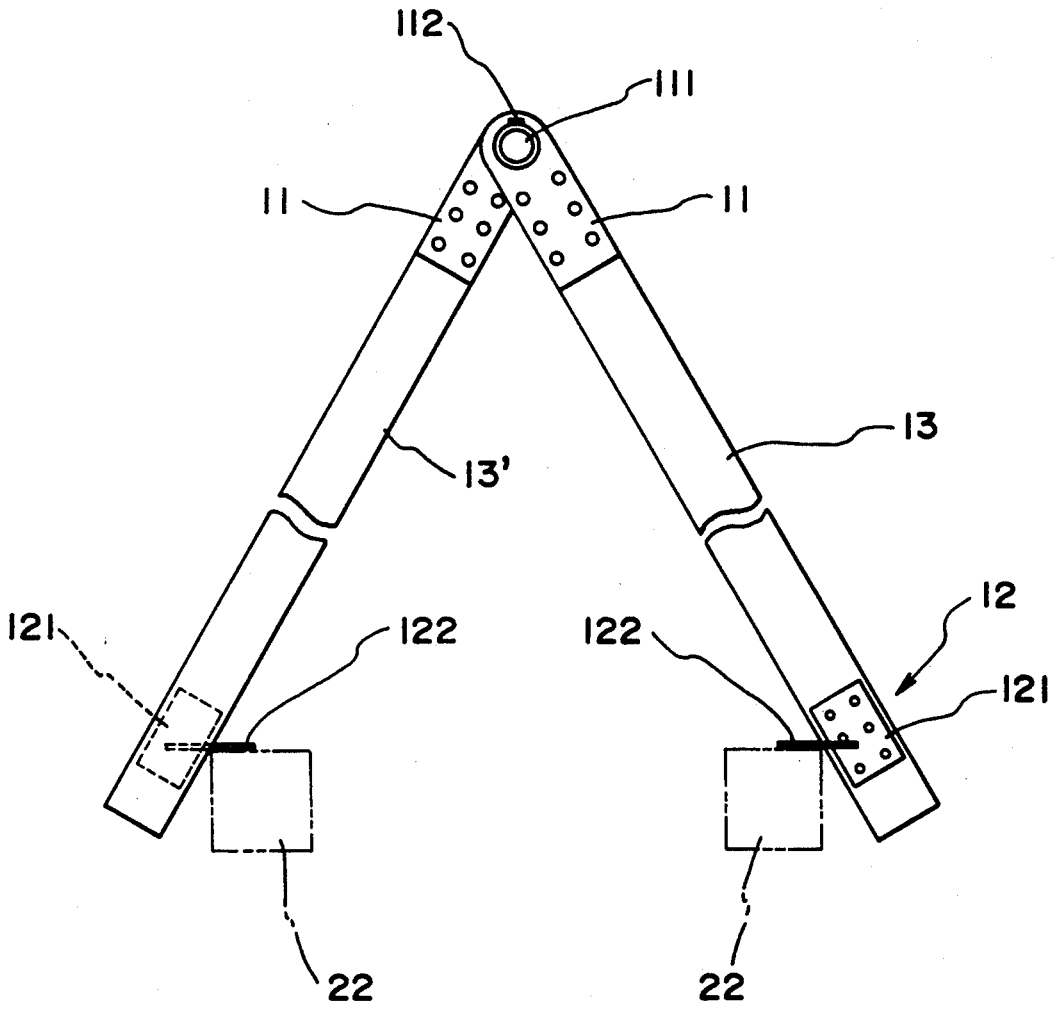
FIG. 4 is a side elevation of the rafters also for use in the roof.
Figure 5:
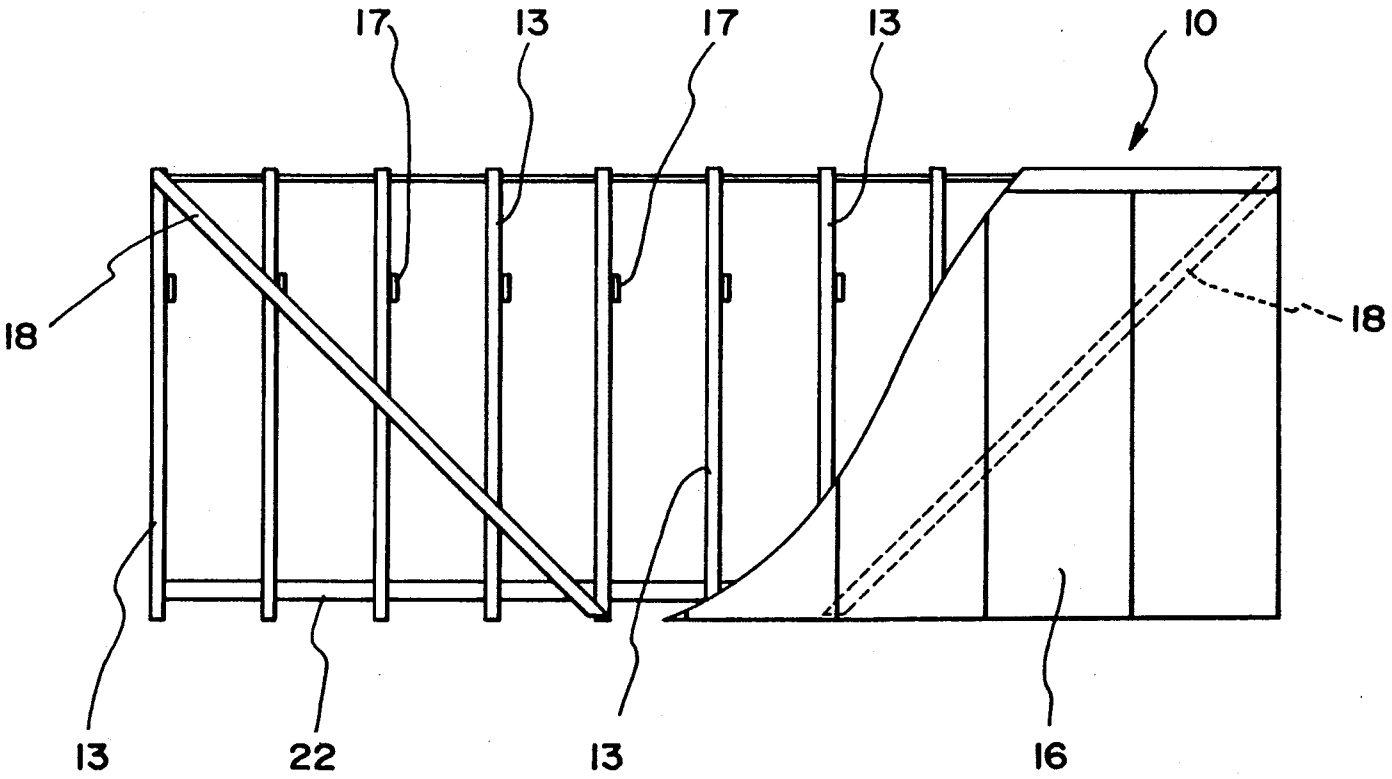
FIG. 5 is a top plan view of the building structure incorporating the roof of the present invention.

Referring now to FIGS. 2 and 4, the roof 10 of the present invention includes a plurality of rafters 13 each having at its upper end a connection 11 and at its lower end a fixing section 12; and a rod 14 such as, for example, a pipe member for horizontally retaining the connections 11 of the rafters 13 at predetermined intervals. The rafters 13 are linked at their respective upper ends with each other in pairs by means of the rod 14, and attached at their respective lower ends to the eaves beams 22 for sloping positioning. Thus, the rod 14 serves as a ridgepole.

As shown in FIG. 1, the fixed rafters 13 support plate materials 15 such as plywoods for defining a sheathing surface 15' which in turn supports roof tile members 16 such as, for example, tin-plates.

The rafters 13 are pitched on both sides of the rod 14. As desired, the pairs of rafters 13, 13' may be linked at their respective trunks with each other by means of reinforcement materials 17, respectively, as shown in FIG. 1. Moreover, reinforcement materials 18 may be diagonally provided between adjacent pairs of rafters 13, 13, and 13', 13' which are parallelly disposed.

The connection 11 usually includes a through-hole 111 for loosely receiving the rod 14 as shown in FIGS. 2 and 4, or alternatively may include a hooked end for engagement with the rod 14.

Furthermore, the connection 11 is preferably provided with a means for fixing the rod 14, for example, a fastening screw 112, thereby ensuring a secure fixation of the rafters 13.

The fixing section 12 includes a locking rod 122 fused to an iron piece 121 firmly attached on the rafter 13, as shown in FIGS. 2 and 4. The locking rod 122 is engaged with the eaves beam 22 while the rafter 13 is nailed onto the eaves beam 22 by means of a linkage piece 131. The rafter 13 may be fitted onto the rod 14 one after another, or conveniently the pair of rafters 13, 13' may be simultaneously provided as right and left rafters.

Figure 6:
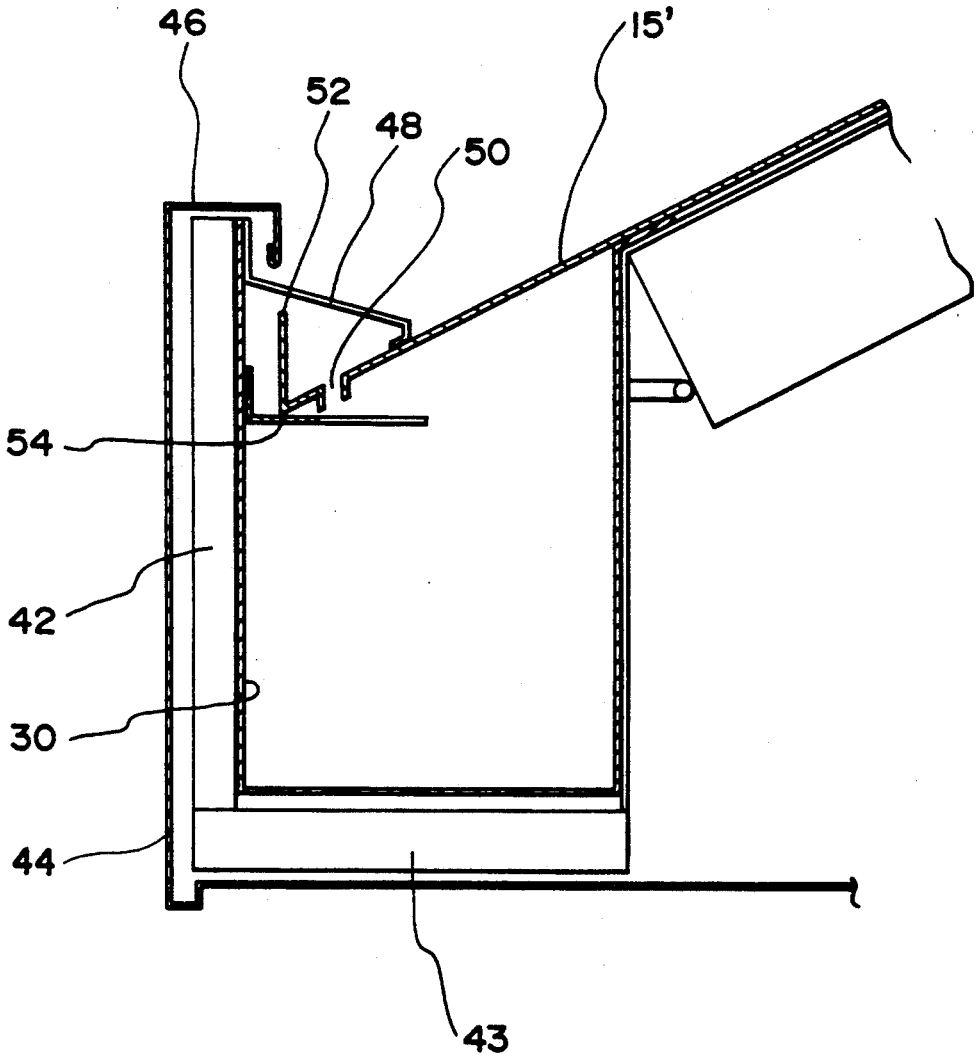
FIG. 6 is a sectional view showing the eaves trough provided in the building structure of the present invention.

Referring next to FIG. 6, in the region of the lower edge of the sheathing surface 15' there is placed a channel-like curved eaves trough 30. The trough 30 has one open end extending in connection with the back of the sheathing surface 15' and bent at any angle for keeping the bottom parallel with respect to the ground, and the other end vertically extending in contact with a wall material 42.

The trough 30 is concealed from view due to the presence of the wall material 42 and a bottom plate material 43. In addition, an external cladding steel plate 44 is disposed so as to cover the wall material 42 and the bottom plate material 43, thereby presenting a good exterior appearance and sharing an excessive load arising from rainwater or the like and which would be otherwise applied only to the trough 30.

The lower edge of the sheathing surface 15' overhangs into the eaves trough 30 so that the rainwater or the like coming down along the sheathing surface 15' drops through a drainage hole 50 provided in the vicinity of the lower edge of the sheathing surface 15, flows by way of the eaves trough 30 and is discharged outside through a drainspout not shown.

Reference numeral 48 denotes a drip cover which permits water to pass therethrough having one end disposed on the sheathing surface 15' and the other end extending along the wall material 42. A portion of the drip cover 48 resting on the sheathing surface 15' is bent for greater strength.

Reference numeral 46 designates a capping member which caps together the drip cover 48, the eaves trough 30, the wall material 42, and the external cladding plate 44 from right to left in the drawing for further stabilization thereof.

Reference numeral 54 signifies a root catch on which a vertical edge 52 of the sheathing surface 15' is placed. The rainwater which has overflowed the vertical edge 52 located at the extremity of the sheathing surface 15' flows along the L-shaped configuration of the root catch 54, and then drops into the eaves trough 30. The rainwater is thus received in the eaves trough 30 regardless of the rainfall, and hence is not brought into excessive contact with the wall material 42. Consequently, there is no fear of corrosion.

The roof thus configured in accordance with the present invention can be assembled by the following procedure by way of example.

The first step comprises mounting the crossbeams 23 between the eaves beams 22 and laying the plywood thereon to form the floor 24, as described above.

In the second step, the rod 14 is hoisted by means of a crane or the like so that the rod 14 is positioned above the building structure 20. At that time, a pair of rafters 13, 13' are previously engaged with one end of the rod 14, and their respective fixing sections 12 are secured to the corresponding eaves beams when hoisting the rod 14. Through the other free end of the rod 14 carried above the building structure by means of a tentative support pillar, the combined rafters consisting of the pair of rafters 13, 13' are successively mounted and the fixing sections of the pairs of rafters are secured to the corresponding eaves beams at predetermined intervals.

While fixing the rafters 13, 13' or after fixing the rafters, the plate materials 15 are fixed to span the adjacent rafters to form the sheathing surface 15'.

After the formation of the sheathing surface 15' in this manner, the roof tile members 16 are laid on the sheathing surface 15'. Subsequently, at the extremity of the sheathing surface 15' there are provided the eaves trough 30, the wall material 42 and the like for the completion of the roof.

The roof of the present invention is thus formed on the eaves beams 22 with the aid of the rafters 13, 13' and the rod 14, thereby presenting a simple inner frame work as well as defining a wider attic space. In addition, at the time of remodeling, not only the tilt and height of the roof can be freely set through the adjustment of the length of the rafters 13, 13' and the rotational angle around the rod 14, but also the roof portion can be solely removed for easy remodeling, thus conveniently ensuring a simple and low-cost remodeling work while continuing the residence. Also, the provision of the eaves trough 30 having the root catch 54 advantageously results in a smooth drainage of the rainwater.

The present invention is not confined to the above described embodiment, but may be otherwise and optionally embodied or practiced without departing from the spirit or essential character thereof.

What is claimed is:

1. A roof comprising;

a plurality of rafters 13, 13' each having at its upper end a connection 11 and having at its lower end a fixing section 12; and a rod 14 for retaining said connections of said rafters at predetermined intervals, wherein said fixing sections 12 of said rafters 13, 13' are secured to corresponding eaves beams 22 of a building structure, and wherein said rafters 13, 13' are arranged on both sides of said rod 14 so as to raise and support said rod 14 at a predetermined height, said rafters 13, 13' and said rod 14 constituting a roof frame in cooperation; further comprising:

a sheathing surface 15' formed over said rafters 13, 13' and having a lower edge;

a drainage hole 50 provided in the vicinity of the lower edge of said sheathing surface 15';

an eaves trough 30 disposed below said drainage hole 50;

a vertical portion 52 obtained by an upwardly bent portion of the lower edge of said sheathing surface 15';

a root catch 54 on which said vertical portion 52 is placed; and a drip cover 48 for covering an extremity side of the lower edge of said sheathing surface 15'.

* * * * *